United States Patent [19]

Cosgrove

[11] Patent Number: 4,543,757

[45] Date of Patent: Oct. 1, 1985

[54] POST SUPPORT AND PROTECTOR

[76] Inventor: Eunice M. Cosgrove, 25306 Crocker La., El Toro, Calif. 92630

[21] Appl. No.: 520,914

[22] Filed: Aug. 8, 1983

[51] Int. Cl.[4] ..... E02D 27/00

[52] U.S. Cl. ..... 52/295; 52/159; 52/165; 52/166; 52/297; 248/158

[58] Field of Search ..... 52/292, 295, 296, 297, 52/165, 166, 704, 153–164; 248/158, 519, 523, 524

[56] References Cited

U.S. PATENT DOCUMENTS

| | | | |
|---|---|---|---|
| 589,079 | 8/1897 | Glazier | 52/295 |
| 852,555 | 5/1907 | Glassco | 52/166 X |
| 887,217 | 5/1908 | Oliphant | 52/295 |
| 907,817 | 12/1908 | Knoerzer | 52/153 |
| 1,123,105 | 12/1914 | Crews | 52/165 |
| 1,130,089 | 3/1915 | Krolikowski | 52/165 |
| 1,131,864 | 3/1915 | Pierce | 52/165 |
| 1,172,126 | 2/1916 | Finette | 52/295 X |
| 1,679,297 | 7/1928 | Ehrler | 52/165 |
| 1,869,744 | 8/1932 | Goldenstar | 52/159 |
| 1,904,177 | 4/1933 | Swenson | 52/159 |
| 4,096,677 | 6/1978 | Gilb | 52/297 |

FOREIGN PATENT DOCUMENTS

| | | | |
|---|---|---|---|
| 195096 | 4/1924 | United Kingdom | 52/296 |

*Primary Examiner*—Donald G. Kelly
*Assistant Examiner*—Richard E. Chilcot, Jr.
*Attorney, Agent, or Firm*—John H. Lynn

[57] ABSTRACT

A post support and protector includes a pair of members having first portions for attachment to a post and second portion for anchoring within the earth.

8 Claims, 4 Drawing Figures

POST SUPPORT AND PROTECTOR

BACKGROUND OF THE INVENTION

This invention relate generally to devices for supporting and protecting posts such as fence posts, sign posts and the like. This invention relates particularly to a device which mounts to one end of a post to support the end of the post above or near the ground level to protect the post from rotting and becoming unusable.

Various types of post supports are known in the art for supporting posts such as fence posts within a hole in the earth. Typically, such post supports consist of a pair of flat spaced apart metal members between which a post is mounted by bolts or other suitable fasteners. Such supports generally must extend a considerable distance on the post above the ground level to provide adequate support and are used only when there is a roof or other support for the upper ends of the posts.

Generally, the portions of a fence post in or adjacent the ground are the first components of a fence to experience structural failure even if the ends of the post are embedded in concrete. Prolonged exposure of the lower portions of a post to moisture in the soil causes the post to fail while the remainder of a structure supported by the post, such as a fence, remains structurally intact. A person supporting a fence or other device, such as a deck or sign, with wooden posts ordinarily desires that the post will last as long as possible and will often attempt to somehow isolate the post from environmental factors which would tend to destroy the post.

Another problem confronting a person desirous of maintaining a fence or similar device is the replacement of existing posts which may have rotted without the necessity of taking down the entire fence. Replacement of a post embedded in concrete requires extensive excavation to remove the post and surrounding concrete support.

SUMMARY OF THE INVENTION

The present invention overcomes the disadvantages of prior devices for supporting posts by providing a post support and protector which engages all four sides of a typical square post formed of a member such as a four-by-four. The post support according to the invention includes a first portion formed for attachment to the end of a post and a second portion extending from the first portion for anchoring within the earth or within concrete to support the post and protect the post from contact with the earth. The post may be mounted with the first portion of the support member partially covered by the earth, or the first portion of the support member may extend above the earth so that all of the post is supported above ground level.

The post support of the invention may include an inwardly extending projection for placement adjacent the end of the post to aid a user in properly locating the post support upon the post. The invention is preferably formed of sheet metal and comprises two separate members having an L-shaped cross-sections. The lower portions of the support members may include suitable means such as passages therethrough for permitting concrete poured around the lower end thereof to engage the post support to retain the post support against axial motion out of a hole in which it is mounted. The second portions of the support members may also include outwardly extending flanges which engage concrete or other material placed around the post support to retain it in position.

A significant advantage of the post support and protector, according to the invention, is that removal of a few bolts permits removal of sections of a fence to provide easy access for passage of trucks, boats, trailers and other similar vehicles without destroying a section of the fence.

Existing wooden fences may also be repaired simply by cutting off unserviceable posts at ground level, digging out the damaged in-ground part and adding the fence support and protector of the present invention to support the remaining portion of the post.

DESCRIPTION OF THE PREFERRED EMBODIMENT

Figure 1:
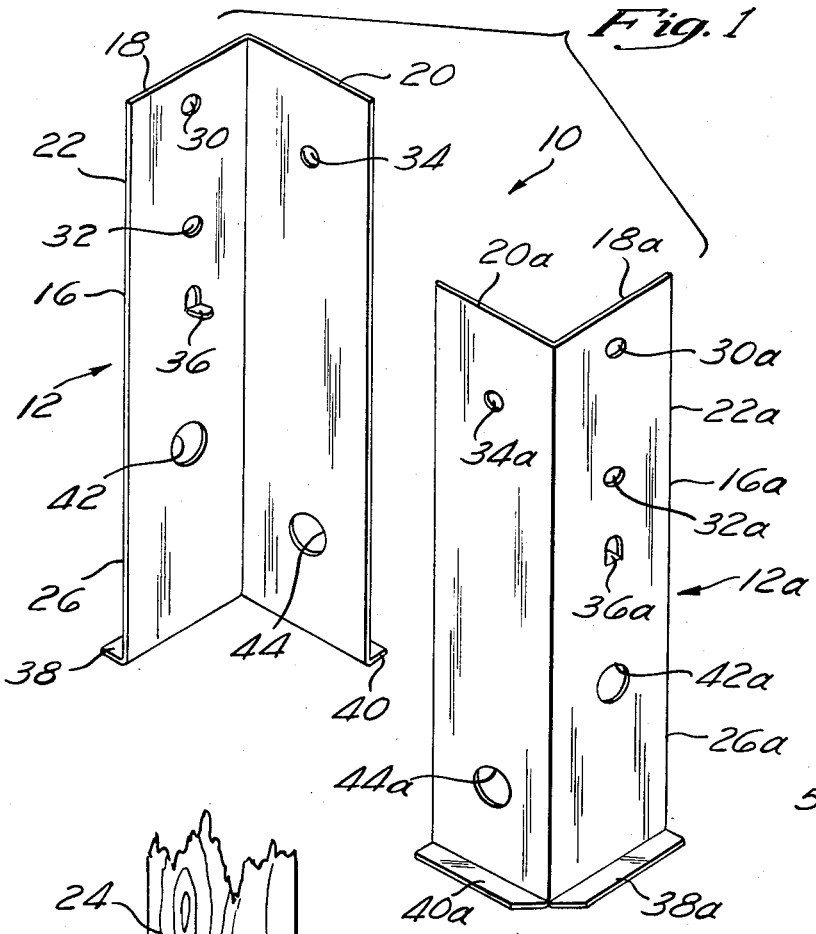
FIG. 1 is a perspective view of a post support and protector according to the invention for use with a rectangular post.

Referring to FIG. 1, a post support and protector 10 comprises a pair of substantially identical support members 12 and 12*a*. The support member 12 comprises an elongate body 16 formed to have a pair of perpendicular legs 18 and 20. The support member 12*a* similarly includes an elongate body 16*a* having perpendicular legs 18*a* and 20*a*. Each of the support members 12 and 12*a* includes a first portion 22 and 22*a*, respectively, for attachment to a post 24, shown in FIG. 2, and a second portion 26 and 26*a*, respectively for insertion into a post hole 28 also shown in FIG. 2.

The first portions 22 and 22*a* include means for mounting the post support and protector 10 to the post 24. In the illustrated embodiment, the first portion 22 includes a pair of passages 30 and 32 in the leg 18, and the first portion 22*a* includes a corresponding pair of passages 30*a* and 32*a*, respectively.

The support member 16 preferably include a projection 36, which defines the boundary between the first and second portions 22 and 26. The support member 16*a* preferably includes a projection 36*a*, which defines the boundary between the first and second portions 22*a* and 26*a*.

The second portion 22 preferably includes a pair of flanges 38 and 40 extending generally perpendicularly therefrom. The second portion 22*a* similarly includes a pair of projections 38*a* and 40*a*. The second portions 16 and 16*a* also preferably include a plurality of passages 42, 44 and 42*a*, 44*a*, respectively, therethrough. The flanges 38, 38*a*, 40, 40*a* and the passages 42, 42, 44 and 44*a*, respectively, provide means for engaging the post support and protector 10 with a material such as concrete for retaining the support and protector 10 within the post hole 28.

The support members 16 and 16*a* are preferably formed of a suitable sheet metal material. The passages 30, 30*a*, 32, 32*a*, 34, 34*a*, 42, 42*a*, 44, 44*a* may be formed in flat rectangles of sheet metal (not shown), which may then be bent by any convenient means, well known in the sheet metal working arts to form the legs 18 and 20 and 18*a* and 20*a*. The projections 36 and 36*a* are conveniently formed by punching a U-shaped slit in the legs 18 and 18*a*, respectively, and then bending the material enclosed within the legs of the U outward to a desired position.

The lengths of the first and second portions 22 and 26, respectively, depend upon the size of the post to be mounted on how deeply the second portion 26 must be imbedded in the earth to prevent alternate freezing and thawing of the earth in some climatic zones from forcing the post support and protector 10 out of the ground. It has been found, by way of example only, that in a region where freezing is unexpected, a length of about twelve inches for the second section 26 and a length of about six inches for the first section 22 provide adequate support for a typical 4"×4" post that extends five feet above ground level.

Figure 2:
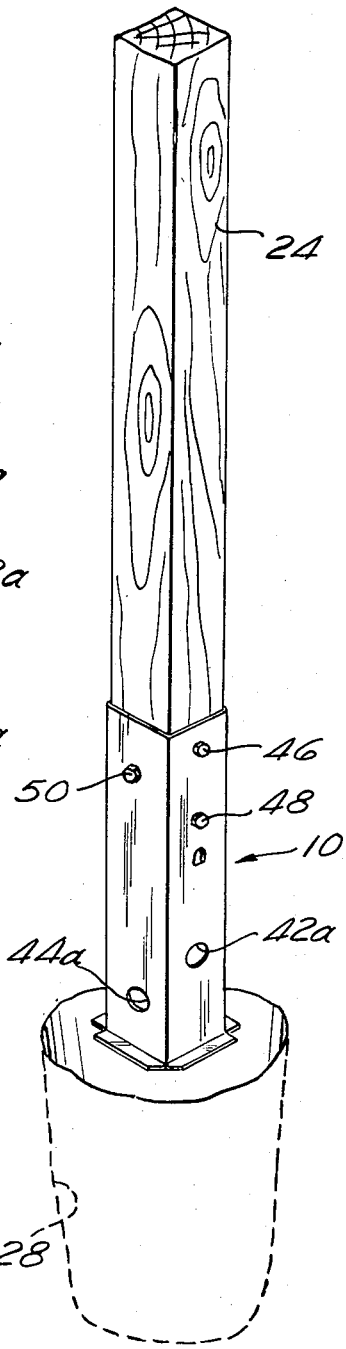
FIG. 2 is a perspective view showing the post support and protector of FIG. 1 attached to a post prior to placement thereof in a post hole in the earth.
Figure 3:
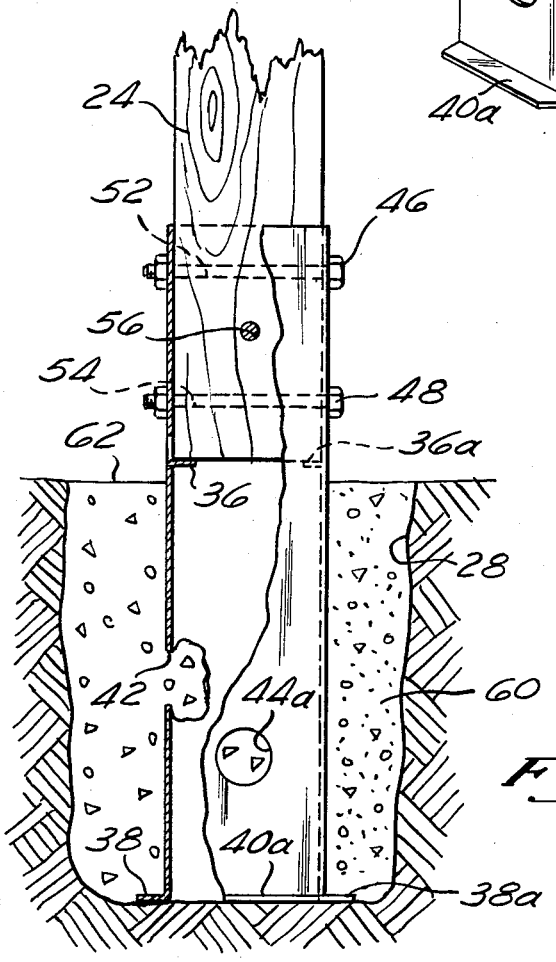
FIG. 3 is a cross-sectional view showing the post support and protector of FIGS. 1 and 2 attached to a post and secured within a post hole.

FIG. 2 illustrates the post support and protector 10 assembled and mounted to the post 24, and FIG. 3 illustrates the assembly anchored within the post hole 28. Suitable fasteners, such as bolts 46, 48 and 50, are passed through the corresponding passages 30 and 30*a*, 32 and 32*a*, 34 and 34*a*, respectively, with the support members 16 and 16*a* being positioned on the post, which is typically a 4×4 wooden post having passages 52, 54 and 56 drilled therethrough for receiving the bolts 46, 48 and 50, respectively. As shown in FIG. 3, the projections 36 and 36*a* support the end of the post 24 so that only a predetermined length of the post 24 may be inserted between the support members 16 and 16*a*.

The support members 16 and 16*a* are mounted to the post 24 which, as shown, has a rectangular cross section so that the flat faces of the legs 18, 18*a*, 20 and 20*a* are on the flat sides of the post 24 with the right angled corner between adjacent legs, such as the legs 18*a* and 20*a*, being aligned with and positioned adjacent a corner 58 of the post 24 as shown in FIG. 2.

Referring to FIG. 3, the assembled post support and protector 10 and post 24 are placed in the posthole 28 to a predetermined depth, and then uncured cement 60 is preferably poured and tamped around the post support and protector 10. The cement covers the flanges 38, 40, 38*a* and 40*a* to retain the post support and protector 10 against axial movement out of the post hole 28. A portion of the cement passes through the passages 42, 42*a*, 44 and 44*a* to form lugs which engage the second portions 26 and 26*a* to retain them against movement relative to the earth. Only a small amount of cement 60 is required for passage through the passages 42, 42*a*, 44 and 44*a* to provide the desired retention of the second portions 26 and 26*a* within the post hole 28. Therefore, in a typical application with cement mixed with the proper amount of water, a small projection of cement will extend through the passages 42, 42*a*, 44 and 44*a*, and the remainder of the volume enclosed within the second portions 26 and 26*a* will contain only air. The bottom of the post hole 28 may include a layer of cement thereon to prevent moisture from rising above the ends of the second portions 26 and 26*a*. Therefore, the post support and protector 10 does not require as much concrete to mount the post 24 within the post hole 28 as would a device that fails to form an enclosure below the end of the post 24.

The post 24 is preferably mounted to have the lower end portion thereof above the ground level 62. When the post 24 is mounted so that the bolts 46, 48 and 50 are at or above the ground level 62, replacement of the post 24 requires only removal of the bolts 46, 48 and 50, withdrawal of the old post 24, insertion of a new post inside the post support and protector 10 and reattachment of the bolts 46, 48 and 50.

The post support and protector 10 may be used to mend a fence (not shown) in which posts were merely embedded in the earth. Such posts ordinarily decay after several years and break off near the ground level. The post hole may be dug again, and the post support and protector 10 may be attached to the lower end of the existing post in the manner described above. The second portions of the support members 16 and 16*a* are then mounted in the post hole and are preferably secured with cement 60. The invention thus permits repair of a fence without taking down the fence and without replacement of the post if only the portion of the post that had been near or below ground level had rotted.

Figure 4:
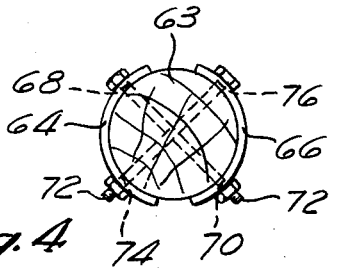
FIG. 4 is a plan view of a post support and protector for use with a round post.

FIG. 4 is a plan view of an embodiment of the post support and protector 10 suitable for use with a round post 63. A pair of support members 64 and 66 are formed to have cross sections that are arcs of circles of predetermined size. The support members 64 and 66 include projections 36 and and 36*a*, and a plurality of passages 68, 70 for receiving a bolt 72 to fasten the support members 64 and 66 to the post 63. The support members 64 and 66 may include flanges similar to the 38 and 38*a* described above with reference to FIGS. 1–3.

Although the invention has been described with reference to specific preferred embodiments, it should be understood that modifications may be made to the preferred embodiments without departing from the spirit of the invention. Accordingly, the invention encompasses the subject matter of the appended claims which distinctly point out the invention.

The support members 64 and 66 include a plurality of passages 74 and 76 for receiving additional bolts 72 to securely connect them to the post 63. The pair of passages 68, 70 and the pair of passages 74, 76 should be at different elevations on the support members 64 and 67 so that the bolts 72 may pass through the post 63 without interfering with one another.

What is claimed is:

1. A support for mounting an end of a post to the earth, comprising:

a pair of support members formed as separate units, each said support member being formed as an elongate body having a first leg and a second leg extending the length thereof with the second leg being substantially perpendicular to the first leg, each said support member including:

a first portion formed for attachment to a post, the post being retained between the pair of support members with the first legs and the second legs, respectively, positioned face-to-face, the first portion including in each of the first and second legs at least one passage for receiving a fastener to fasten the support members to the post; and a second portion extending from the first portion for anchoring within the hole to support the post and to protect the post from contact with the earth, the second portion including at least one flange projecting therefrom, said flange having a horizontal planar surface for receiving material thereon for securing a lower end of the support member in the hole.

2. The support of claim 1 wherein each support member further comprises a locator tab projecting from at least one of said first and second legs for separating the first and second portions of the support member and for locating and supporting the end of the post above the ground level at the juncture of the first and second portions so that there is an air space below the end of the post.

3. The support of claim 1 wherein the securing means includes at least one passage through one of the first and second legs so that a portion of cement placed adjacent the passage passes therethrough to form a lug for bonding the support members to the cement.

4. A method for securing a post inside a hole in the earth, comprising the steps of:

forming a pair of elongate support members, each of elongate support members having a pair of perpendicular legs, a first portion for attachment to the post and a second portion for anchoring within the hole;

forming means for permitting insertion of fasteners through the legs to connect the legs to an end of the post;

forming at least one flange projecting horizontally outwardly from the second portion of one of the support members;

securing the first portions to the post;

placing the second portion in the hole to a predetermined depth; and placing material in the hole around the support members to engage the second portions and the flange to anchor the support members and post to the earth.

5. The method of claim 4 further including the steps of:

forming at least one passage through the second portion of one of the support members; and placing uncured cement around the support members so that a portion of the uncured cement passes through the passage to form a lug for retaining the support member against movement relative to the earth.

6. A method for forming a pair of members for supporting a post in a post hole, comprising the steps of:

forming a pair of rectangles of sheet metal;

punching a slot in each rectangle;

bending material outward from the slots to form projections for supporting an end of a post;

forming a plurality of passages in the rectangles to provide means for receiving fasteners to fasten the members to a post;

forming at least one passage in each rectangle for permitting cement to pass therethrough for retaining the member within the post hole;

bending each rectangle to form each member to have an L-shaped cross section having a pair of generally perpendicular legs for engaging the sides of the post; and bending an end of each rectangle to form a flange at one edge of the member for engaging material placed adjacent the member to retain the member against movement out of the post hole.

7. A method for repairing a fence post that is attached to a fence without removing any fence post from the fence and without removing structurally sound fence posts comprising the fence from their post holes, comprising the steps of:

cutting off the lower end of the fence post above ground level while leaving the upper end of the post attached to the fence;

digging in hole in the earth under the fence post to remove the cut off portion from below the fence post;

forming a pair of elongate support members to each have a pair of generally perpendicular legs, a first portion for attachment to the fence post and a second portion for anchoring within the hole under the fence post;

forming at least one outwardly projecting flange on at least one of the elongate support members;

placing the second portions of the elongate support members in the hole with the first portions of the elongate support members being adjacent the end of the post nearer to the ground;

securing the first portions of the elongate support members to the post above ground level to substantially enclose a portion of the post between the perpendicular legs; and placing material in the hole around the second portions of the elongate support members to engage the flange to anchor the elongate support members to the earth.

8. The method of claim 7 further including the step of leaving an air space below the lower end of the post above ground level.

* * * * *